US005430974A

United States Patent [19]

Hering

[11] Patent Number: 5,430,974

[45] Date of Patent: Jul. 11, 1995

[54] INDICIA DEVICE FOR TURNSTILE AND METHOD OF USE

[76] Inventor: Martin Hering, 10151 University Blvd., Ste 204, Orlando, Fla. 32817

[21] Appl. No.: 189,802

[22] Filed: Feb. 1, 1994

[51] Int. Cl.[6] ..... E06B 11/08

[52] U.S. Cl. ..... 49/47; 40/660; 49/70; 49/506

[58] Field of Search ..... 49/47, 46, 42, 43, 70, 49/506; 40/599, 661, 660

[56] References Cited

U.S. PATENT DOCUMENTS

| | | | |
|---|---|---|---|
| 2,918,741 | 12/1959 | Welter et al. | 40/660 X |
| 3,560,996 | 2/1971 | Berl | 49/47 X |
| 3,913,717 | 10/1975 | Collins | 49/46 X |
| 4,408,406 | 10/1983 | Barton | 40/660 |
| 5,168,600 | 12/1992 | Huang | 40/660 X |

*Primary Examiner*—Philip C. Kannan

*Attorney, Agent, or Firm*—Parsons & Associates; Robert A. Parsons; Don J. Flickinger

[57] ABSTRACT

An indicia device for displaying indicia on an arm of a turnstile, including a tubular sleeve containing indicia, received about the arm and secure thereto by a collar at one end and stabilized by a spacer at the opposing end.

18 Claims, 3 Drawing Sheets

INDICIA DEVICE FOR TURNSTILE AND METHOD OF USE

BACKGROUND OF THE INVENTION

1. Field of the Invention

This invention relates to methods and devices for displaying indicia.

More particularly, the present invention relates to advertising on turnstiles.

In a further and more specific aspect, the present invention concerns an apparatus containing visual information mounted on the arms of turnstile.

2. The Prior Art

Access to public as well as many private facilities is often controlled by devices conventionally referred to as turnstiles. Turnstiles consist of a housing placed in an accessway to define a narrow passageway. This passageway is controlled by an arm extending thereacross. In order to move through the passageway, the arm of the turnstile must be moved aside. Typically, turnstiles have a revolving plate mounted in the housing from which a number of arms extend. An individual moves into the arm presently blocking the passageway, and moves it down and away, rotating the rotating plate. The individual is now free to progress through the passageway, with a subsequent arm rotating up behind the individual to block the passageway from following individuals.

Turnstiles work well to control the flow of a crowd and/or charge and collect admission. However, they also use a large amount of space which could be used for other purposes. Specifically, at the present time, space is at a premium for advertisements. Advertisements generate a large volume of revenue in public event facilities, and are very much an integral portion of our society. Advertisements inform as well as entice individuals. High visibility locations in which to advertise are continually being sought, with prime location subject to a great deal of competition between advertisers.

Advertisements are presented in a wide variety of ways, the most common of which are placing posters in a case or simply tacking a poster to a wall. These are traditional and well established methods, however, these methods are limited by the amount of wall space available. Recently, Video monitors have been used to provide a plurality of ever changing advertisements. This method, while very effective, is also very expensive. Generally speaking, advertisements are prevalent throughout society, with most available space already allocated for advertisements. While there may be some space available, it is generally not highly desirable, being out of the way or less visible than preferred.

Turnstiles occupy a position which is highly trafficked, since everyone must pass through the turnstiles, and highly visible since most people look at the turnstile as they pass through. Conventional turnstiles, however, do not take advantage of their premier location, and while they perform their blocking functions admirably, take up advertising space, and more importantly, take peoples eyes off wall advertisements as they concentrate on passing the turnstile.

It would be highly advantageous, therefore, to remedy the foregoing and other deficiencies inherent in the prior art.

Accordingly, it is an object of the present invention to provide a new and improved turnstile.

Another object of the present invention is to provide an indicia device for use on a conventional turnstile.

And another object of the present invention is to provide a method of advertising on a turnstile.

Still another object of the present invention is to provide a relatively inexpensive and highly effective method of advertising.

Yet another object of the present invention is to provide a relatively inexpensive indicia device for use on turnstiles.

Yet still another object of the present invention is to provide an indicia device easily installable on substantially any turnstile apparatus.

A further object of the present invention is to provide an indicia device in which the indicia may be readily changed.

And a further object of the present invention is to provide an indicia device which can be readily attached without alteration to the turnstile and with conventional tools.

Yet a further object of the present invention is to provide an indicia device which can be constructed of conventional materials using conventional techniques.

And yet a further object of the present invention is to provide an indicia device which can be constructed in a variety of configurations to meet an individual users criteria.

SUMMARY OF THE INVENTION

Briefly, to achieve the desired objects of the present invention in accordance with a preferred embodiment thereof, provided is an indicia device for displaying indicia on a turnstile having an arm with a free end. The indicia device includes a tubular sleeve containing indicia which is receivable about the arm. The tubular sleeve includes an arm receiving end and an opposing free end. The indicia device also includes coupling means for coupling the sleeve to the arm.

The coupling means includes a collar configured to adjustably and securely engage the arm and an attachment member for attaching the arm receiving end of the tubular sleeve to the collar. The collar includes an arm securing portion for coupling the collar to the arm, a sleeve securing portion for securing the tubular sleeve to the collar and a bore extending through the arm securing portion and the sleeve securing portion for receiving the arm.

Also provided is seal means for sealing the collar to the tubular sleeve, an end cap closing the free end of the tubular sleeve, a spacer extending centrally from the end cap into the free end of the tubular sleeve and a bore formed in the spacer for receiving the free end of the arm.

The tubular sleeve is transparent, and the indicia is carried on a sheet inserted into the tubular sleeve.

In accordance with a further embodiment of the invention, a method of displaying indicia on a turnstile is also contemplated.

BRIEF DESCRIPTION OF THE DRAWINGS

The foregoing and further and more specific objects and advantages of the instant invention will become readily apparent to those skilled in the art from the following detailed description of a preferred embodiment thereof, taken in conjunction with the drawings, in which.

DETAILED DESCRIPTION OF THE PREFERRED EMBODIMENT

Figure 1:
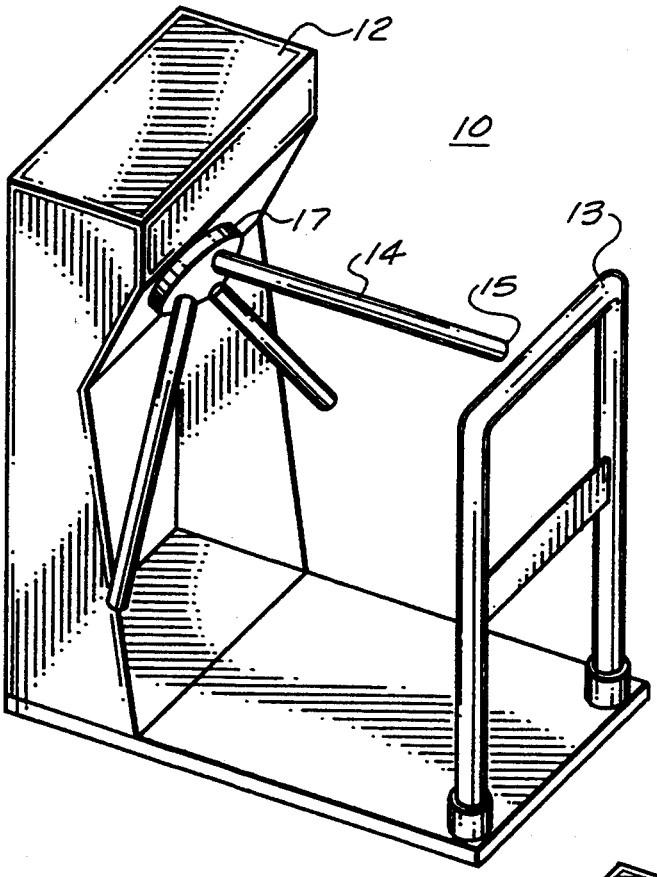
FIG. 1 is a perspective view illustrating a turnstile device.

Turning now to the drawings in which like reference characters indicate corresponding elements throughout the several views, attention is first directed to FIG. 1 which illustrates a turnstile device generally designated 10 consisting of a housing 12 opposed by an obstruction 13. Housing 12 and obstruction 13 define a passageway therebetween, alternately blocked by one of three arms 14, each having a free end 15. Arms 14 extend from a plate 17 rotatably mounted on housing 12 such that one of arms 14 extend across the passageway at any given time. As an individual moves through the passageway, the arm blocking the passageway is rotated out of the way allowing an individual to pass through. As the arm is moved, another arm rotates up behind the individual, again blocking the passageway.

Set forth for purposes of orientation and reference in connection with the ensuing detailed description of the preferred embodiment of the instant invention, the foregoing brief description of turnstile 10 is intended to be generally representative of typical, commercially available turnstiles. Details not specifically illustrated and described will be readily understood and appreciated by those skilled in the art.

Figure 2:
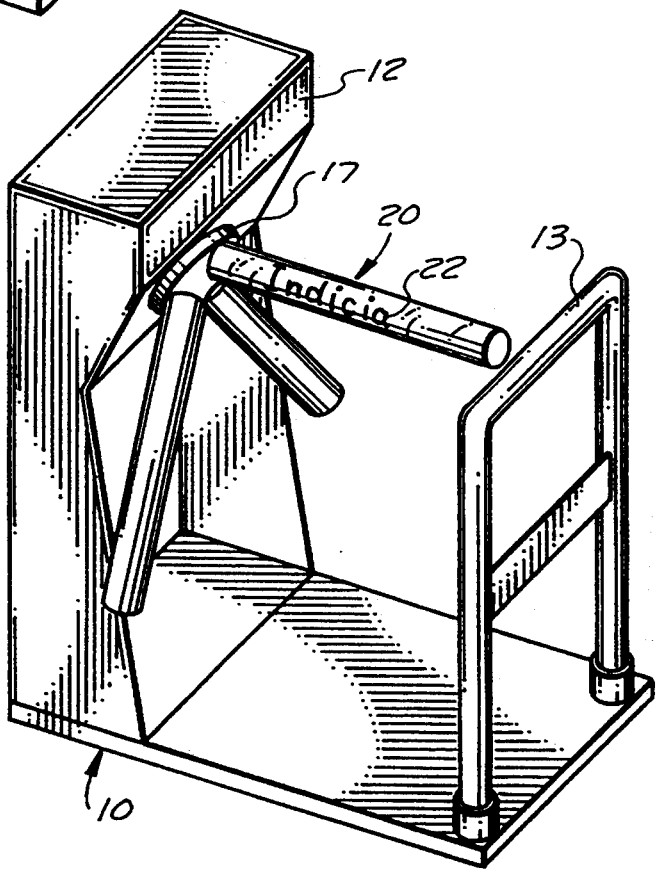
FIG. 2 is a perspective view illustrating an indicia device constructed in accordance with the teachings of the present invention as it would appear installed on the turnstile device of FIG. 1.

With reference to FIG. 2, turnstile 10 is illustrated with indicia devices, generally designated 20, installed on arms 14. Indicia device 20 encloses arm 14, and contains visual information or indicia 22. Indicia 22 is preferably positioned so as to be in proper orientation for viewing when arm 14 is in the blocking position. Identical or diverse indicia may be carried by individual indicia devices 20. If diverse indicia is employed between separate indicia device 20, each diverse indicia would be viewed as the appropriate arm rotates to the blocking position.

Still referring to FIG. 2, three separate indicia devices 20 are shown installed on three separate arms 14. One skilled in the art will understand that each arm need not be covered. Furthermore, a turnstile device may have more than three or less than three arms. One skilled in the art will understand that substantially any turnstile device having arms may be improved by the installation of one or more indicia devices 20.

Figure 3:
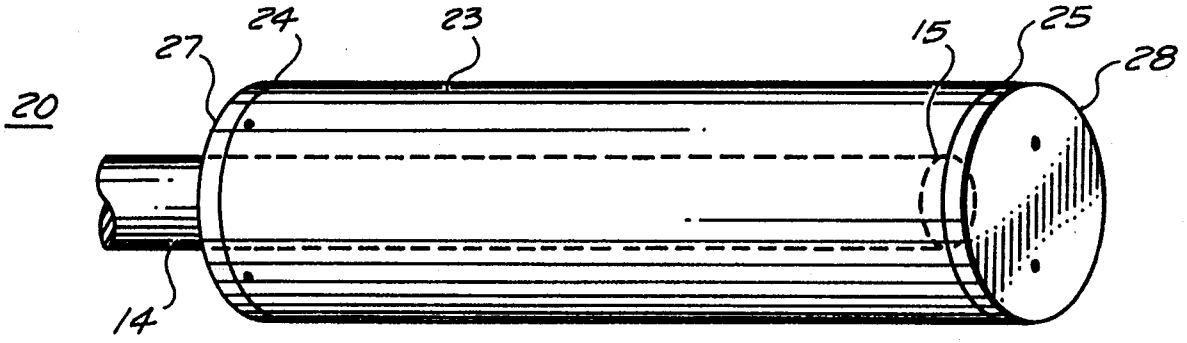
FIG. 3 is an isometric view of the indicia device of FIG. 2.

Indicia device 20 is a generally tubular sleeve configured to fit over and enclose arm 14 as can be seen in FIG. 3. Indicia device 20 consists of a tubular sleeve 23 having an arm receiving end 24 and a free end 25. Arm receiving end 24 is closed by a collar 27 configured to receive arm 14 therethrough, and free end 25 is closed by an end cap 28. With additional reference to FIG. 4, collar 27 includes a sleeve securing portion having an outer portion 29 and an inner portion 30, and an arm securing portion 32. Outer portion 29 has a diameter substantially equivalent to the diameter of an outer surface 33 of tubular sleeve 23 and engages arm receiving end 24. Inner portion 30 has a diameter substantially equivalent to the diameter of an inner surface 34 of tubular sleeve 23, and is received in tubular sleeve 23 at arm receiving end 24. A groove 35 is circumscribed around the periphery of intermediate member 30 and contains a seal ring 37 which engages inner surface 34 sealing tubular sleeve 23. This is to prevent moisture or other detrimental materials from entering tubular sleeve 23 and damaging indicia 22. Arm securing portion 32 extends into arm receiving end 24 and has a diameter less than the diameter of inner surface 34 and therefore is spaced from inner surface 34. A bore 38 is formed centrally through collar 27, extending through outer portion 29, inner portion 30, and arm securing portion 32. Bore 38 has a diameter sufficient to receive arm 14 therethrough. Set screws 39 extend through arm securing portion 32, into bore 38 and engage arm 14, securely fixing collar 27 to arm 14. In this specific embodiment, two set screws are employed separated by approximately 90 degrees. Threaded holes 40 are formed around the outer edge of inner portion 30, and align with corresponding holes 42 formed through tubular sleeve 23 proximate arm receiving end 24. Screws (not shown) extend through holes 42 and thread into threaded holes 40, securely holding tubular sleeve 23 onto collar 27 and thereby, onto arm 14.

Figure 4:
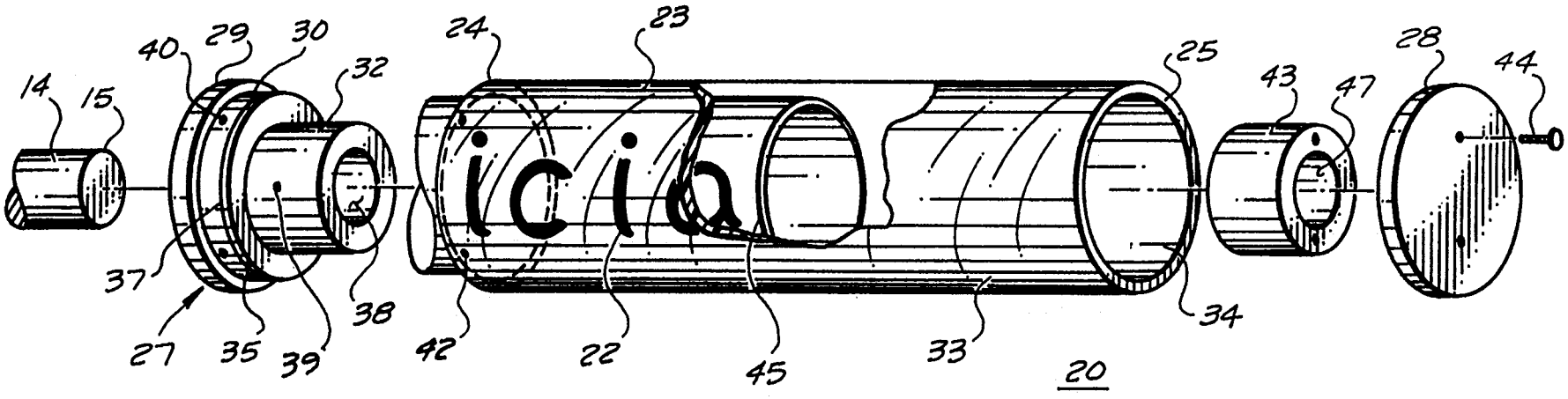
FIG. 4 is an exploded view of the indicia device of FIGS. 2 and 3.

Still referring to FIG. 4, end cap 28 has a diameter substantially equivalent to outer surface 33 of tubular sleeve 23 and is fixed to free end 25. In this embodiment, end cap 28 is bonded to free end 25 using an adhesive, but substantially any method may be employed to securely attach end cap 28 to free end 25. A spacer 43 is coupled centrally to the inside of end cap 28 and is configured to extend into tubular sleeve 23 at free end 25. Spacer 43 is coupled to end cap 28 by attachment members, such as screws 44, extending through end cap 28 into spacer 43. One skilled in the art will appreciate that an adhesive or other attachment means may be used to fix spacer 43 to end cap 28. Spacer 43 is positioned centrally within tubular sleeve 23 at free end 25, and has a diameter less than the diameter of inner surface 34, thereby creating a space between spacer 43 and inner surface 34. A sheet 45 of material carrying indicia 22 is rolled into a tube with indicia 22 visible on the outer surface thereof, and inserted into tubular sleeve 23. When properly positioned, sheet 45 preferably extends from collar 27 to end cap 28, with its outer surface pressing against inner surface 34. It will be understood that a shorter sheet may be inserted which would not extend from collar 27 to end cap 28, however this is not preferred since this would permit viewing of the interior of tubular sleeve 23.

Tubular sleeve 23 is preferably constructed of a transparent material, through which indicia 22 is visible. Substantially any clear material may be employed for tubular sleeve 23, however, it must be strong enough to withstand repeated contact by individuals passing through the passageway. The preferred material for tubular sleeve 23 is a caste acrylic, an extruded acrylic or polycarbonate. One skilled in the art will understand that while a transparent tubular sleeve 23 containing a sheet 45 is preferred, a tubular sleeve may be employed having indicia directly thereon. Collar 27, and spacer 43, may be constructed of substantially any material, such as metal or plastic, but the specifically preferred materials are nylon, polyvinylchloride, or Delrin. End cap 28 may be the same materials, but for purely esthetic reasons acrylic is preferred, since it can be produced in a variety of color options.

Indicia device 20 is easily installed on arm 14 of turnstile 10 without altering the turnstile and without using specialized tools, by first sliding collar 27 onto arm 14 such that arm extends through bore 38. Set screws 39 are tightened, engaging arm 14 and securing collar 27 thereto. Sheet 45, containing indicia 22, is rolled and inserted into tubular sleeve 23 in the proper orientation. Sheet 45 may be formed of substantially any material which can be rolled, and onto which indicia can be placed, such as paper, plastic, photographic paper, metal foils etc. Tubular sleeve 23 containing sheet 45 is received about arm 14 and coupled to collar 27 by inserting screws (not shown) through holes 42 into threaded holes 40. Due to the length of tubular sleeve 23, in order to insure spacing of free end 25 from arm 14, and to stabilize it for contact with individuals passing through the passageway, spacer 43 includes a bore 47 extending therethrough which receives free end 15 of arm 14, thereby positioning and securing free end 25. In this manner, indicia 22 is visible through and protected by tubular sleeve 23. Furthermore, sheet 45 may be easily changed by removing tubular sleeve 23 from collar 27 and replacing sheet 45.

Figure 5:
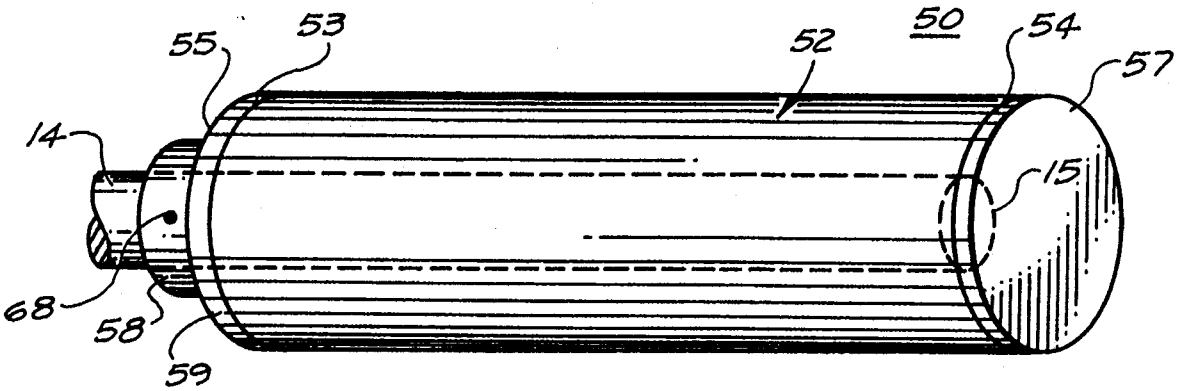
FIG. 5 is an isometric view of an alternate embodiment of an indicia device.
Figure 6:
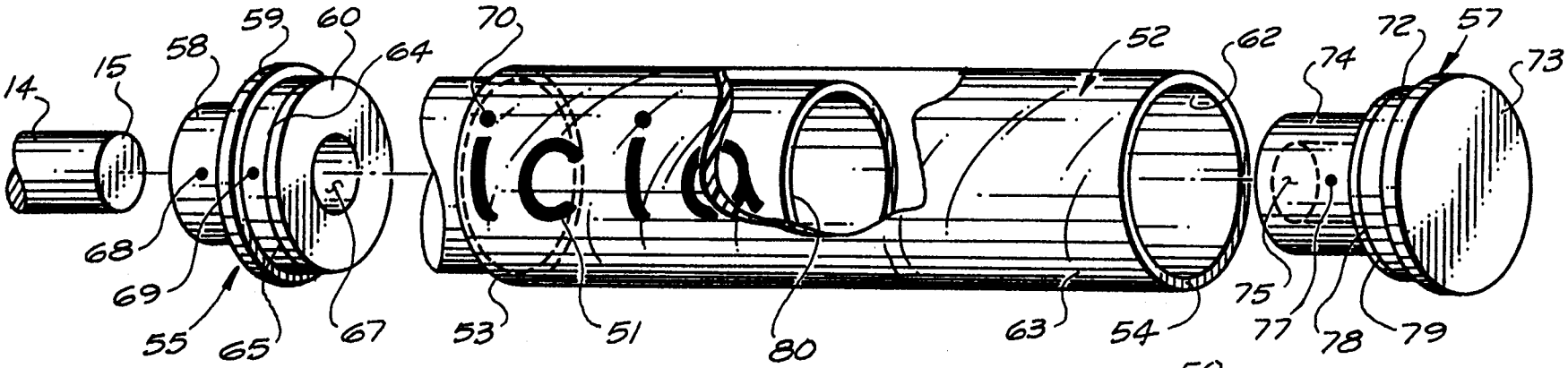
FIG. 6 is an exploded view of the indicia device of FIGS. 5.

Reference is now made to FIGS. 5 and 6 which illustrate an alternate embodiment of an indicia device incorporating the teachings of the present invention and generally designated by the reference character 50. Indicia device 50 is generally similar to previously described embodiment 20 and is similarly configured to fit over and enclose arm 14 to display indicia 51. Indicia device 50 consists of a tubular sleeve 52 having an arm receiving end 53 and a free end 54. Arm receiving end 53 is closed by a collar 55 configured to receive arm 14 therethrough, and free end 54 is closed by an end cap 57. With additional reference to FIG. 6, collar 55 includes an arm securing portion 58 and a sleeve securing portion having an outer portion 59, and an inner portion 60. Inner portion 60 has a diameter substantially equivalent to the diameter of an inner surface 62 of tubular sleeve 52, and is received in tubular sleeve 52 at arm receiving end 53. Outer portion 59 has a diameter substantially equivalent to the diameter of an outer surface 63 of tubular sleeve 52 and engages arm receiving end 53. A groove 64 is circumscribed around the periphery of inner portion 60 and contains a seal ring 65 which engages inner surface 62 sealing tubular sleeve 52. As with the previous embodiment, this is to prevent moisture or other detrimental materials from entering tubular sleeve 52 and damaging indicia 51. Arm securing portion 58 has a diameter less than the diameter of inner surface 62 and extends outward from outer member 59, away from tubular sleeve 52. A bore 67 is formed centrally through collar 55, extending through arm securing portion 58, outer portion 59, and inner portion 60. Bore 67 has a diameter sufficient to receive arm 14 therethrough. Set screws 68 extend through arm securing portion 58, into bore 67 and engage arm 14, securely fixing collar 55 to arm 14. In this immediate embodiment, two set screws are employed separated by approximately 90 degrees. Threaded holes 69 are formed around the outer edge of inner portion 60 and align with corresponding holes 70 formed through tubular sleeve 52 at arm receiving end 53. Screws (not shown) extend through holes 70 and thread into threaded holes 69, securely holding tubular sleeve 52 onto collar 55 and thereby, onto arm 14.

Still referring to FIG. 6, end cap 57 includes an inner portion 72 having a diameter substantially equivalent to the diameter of inner surface 62 and an outer portion 73 having a diameter substantially equivalent to the diameter of outer surface 63. A spacer 74 may be formed integrally with or secured to inner portion 72 and is positioned centrally within tubular sleeve 52 at free end 54. Spacer 74 has a diameter less than the diameter of inner surface 62, thereby creating a space between spacer 74 and inner surface 62. A bore 75 extends through spacer 74 terminating at end cap 57. Bore 75 has a diameter sufficient to receive free end 15 of arm 14 therein. Set screws 77 extend through spacer 74 into bore 75 and engage arm 14, securely fixing spacer 74 to arm 14. In this specific embodiment, two set screws are employed separated by approximately 90 degrees.

In this embodiment, inner portion 72 of end cap 57 is received within free end 54 and has a groove 78 circumscribed about its periphery. Groove 78 contains a seal ring 79 which engages inner surface 62 sealing tubular sleeve 52. As with the previous embodiment, a sheet 80 of material carrying indicia 51 is rolled into a tube with the indicia visible on the outer surface thereof, and inserted into tubular sleeve 52. When properly positioned, sheet 80 preferably extends from collar 55 to end cap 57, with its outer surface pressing against inner surface 62. It will be understood that a shorter sheet may be inserted which would not extend from collar 55 to end cap 57, however this is not preferred since this would permit viewing of the interior of tubular sleeve 52.

Indicia device 50 is easily installed on arm 14 of turnstile 10 without altering the turnstile and without using specialized tools, by first sliding collar 55 onto arm 14 such that arm 14 extends through bore 67. Sheet 80 of material containing indicia 51 is rolled and inserted into tubular sleeve 52 in the proper orientation. Sheet 80 may be formed of substantially any material which can be rolled, and onto which indicia can be placed, such as paper, plastic, photographic paper, metal foils etc. Tubular sleeve 52 containing sheet 80 is received about arm 14 and coupled to collar 55 by inserting screws (not shown) through holes 70 into threaded holes 69. Spacer 74 and end cap 57 are then positioned with free end 15 of arm 14 received within spacer 74. Set screws 77 are tightened, engaging free end 15 and securing end cap 57 to arm 14. Tubular sleeve 52 is moved outward, towards end cap 57 until outer portion 58 engages free end 54 of tubular sleeve 52. Collar 55 is moved outward toward end cap 57, until outer portion 59 engages arm receiving end 53 of tubular sleeve 52. Set screws 68 are tightened, engaging arm 14 and securing collar 55 thereto. In this manner, tubular sleeve 52 is securely retained between collar 55 and end cap 57 and indicia 51 is visible through and protected by tubular sleeve 52. Furthermore, sheet 80 may be easily changed.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. An indicia device for displaying indicia on a turnstile having an arm with a free end, said indicia device comprising:

a tubular sleeve containing indicia and receivable about said arm, said tubular sleeve including an arm receiving end and an opposing free end; and coupling means for coupling said sleeve to said arm, said coupling means including a collar configured to adjustably and securely engage said arm, and an attachment member for attaching said arm receiving end of said tubular sleeve to said collar.

2. An indicia device as claimed in claim 1 wherein said collar includes:

an arm securing portion for coupling said collar to said arm;

a sleeve securing portion for securing said tubular sleeve to said collar; and a bore extending through said arm securing portion and said sleeve securing portion for receiving said arm.

3. An indicia device as claimed in claim 2 wherein said arm securing portion is secured to said arm by set screws extending through said arm securing portion into said bore.

4. An indicia device as claimed in claim 2 wherein said sleeve securing portion includes:

an inner portion receivable within said arm receiving end of said tubular sleeve; and an outer portion engagable with said arm receiving end of said tubular sleeve.

5. An indicia device as claimed in claim 4 wherein said attachment member is a screw extending through said tubular sleeve proximate said arm receiving end into said inner portion.

6. An indicia device as claimed in claim 4 wherein said collar further includes seal means for sealing said collar to said tubular sleeve.

7. An indicia device as claimed in claim 2 further including:

an end cap closing said free end of said tubular sleeve;

a spacer extending centrally from said end cap into said free end of said tubular sleeve; and a bore formed in said spacer for receiving said free end of said arm.

8. An indicia device as claimed in claim 7 wherein said spacer is coupled to said arm by a set screw extending through said spacer to engage said arm.

9. An indicia device as claimed in claim 7 wherein said tubular sleeve is transparent, and said indicia is carried on a sheet inserted into said tubular sleeve.

10. A turnstile for carrying indicia, said turnstile comprising:

a housing;

an arm having a free end, rotatably carried by said housing;

a tubular sleeve containing indicia covering said arm, said tubular sleeve including an arm receiving end and an opposing free end; and coupling means for coupling said sleeve to said arm.

11. A turnstile as claimed in claim 10 wherein said tubular sleeve is transparent, and said indicia is carried on a sheet inserted into said tubular sleeve.

12. A turnstile as claimed in claim 10 wherein said coupling means includes:

a collar configured to adjustably and securely engage said arm; and an attachment member for attaching said arm receiving end of said tubular sleeve to said collar.

13. An indicia device as claimed in claim 12 wherein said collar includes:

an arm securing portion for coupling said collar to said arm;

a sleeve securing portion for securing said tubular sleeve to said collar; and a bore extending through said arm securing portion and said sleeve securing portion for receiving said arm.

14. A turnstile as claimed in claim 13 further including:

an end cap closing said free end of said tubular sleeve;

a spacer extending centrally from said end cap into said free end of said tubular sleeve; and a bore formed in said spacer for receiving said free end of said arm.

15. A turnstile device as claimed in claim 14 wherein said tubular sleeve is transparent, and said indicia is carried on a sheet inserted into said tubular sleeve.

16. A method of displaying indicia on a turnstile having an arm with a free end, said method comprising the steps of:

providing a collar configured to adjustably and securely engage said arm;

providing a tubular sleeve containing indicia and receivable about said arm, said tubular sleeve including an arm receiving end and an opposing free end;

securing said collar onto said arm; and covering said arm with said tubular sleeve and securing said arm receiving end of said tubular sleeve to said collar.

17. A method as claimed in claim 16 further including the step of supporting said free end of said tubular sleeve with a spacer having a bore, said spacer being carried within said free end of said tubular sleeve for receiving said free end of said arm.

18. A method as claimed in claim 17 wherein said step of covering said arm includes inserting a sheet containing indicia into said tubular sleeve.

* * * * *